US011342699B2

(12) United States Patent
Hirota

(10) Patent No.: US 11,342,699 B2
(45) Date of Patent: May 24, 2022

(54) TERMINAL FITTING, METHOD OF PRODUCING THE SAME, AND CONNECTOR

(71) Applicant: SUMITOMO WIRING SYSTEMS, LTD., Mie (JP)

(72) Inventor: Masanori Hirota, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/950,930

(22) Filed: Nov. 18, 2020

(65) Prior Publication Data

US 2021/0175652 A1 Jun. 10, 2021

(30) Foreign Application Priority Data

Dec. 4, 2019 (JP) ..... JP2019-219228

(51) Int. Cl.

| | |
|---|---|
| ***H01R 13/05*** | (2006.01) |
| ***H01R 4/18*** | (2006.01) |
| ***H01R 13/11*** | (2006.01) |
| ***H01R 43/16*** | (2006.01) |
| ***H01R 13/422*** | (2006.01) |
| ***H01R 13/58*** | (2006.01) |

(52) U.S. Cl.

CPC ..... *H01R 13/055* (2013.01); *H01R 4/185* (2013.01); *H01R 13/113* (2013.01); *H01R 13/422* (2013.01); *H01R 13/5808* (2013.01); *H01R 43/16* (2013.01)

(58) Field of Classification Search

CPC ..... H01R 13/11; H01R 13/111; H01R 13/114; H01R 13/41; H01R 13/055; H01R 13/113; H01R 13/422; H01R 13/5808; H01R 13/16; H01R 4/185

USPC ..... 439/884

See application file for complete search history.

(56) References Cited

U.S. PATENT DOCUMENTS 3,836,947 A * 9/1974 Yeager ..... H01R 13/113 439/852
4,781,628 A * 11/1988 Detter ..... H01R 13/432 439/748
5,266,056 A * 11/1993 Baderschneider ... H01R 13/432 439/745

(Continued)

FOREIGN PATENT DOCUMENTS

JP 2003-022859 A 1/2003
JP 2011-154944 A 8/2011

(Continued)

*Primary Examiner* — Peter G Leigh
(74) *Attorney, Agent, or Firm* — Abelman, Frayne & Schwab

(57) ABSTRACT

A terminal fitting 10 is provided with a body portion 11 having a tubular shape and extending in a front-rear direction. The body portion 11 includes an outer wall portion 17 arranged from one end toward another end in a width direction. The outer wall portion 17 includes a bent portion 43 curved on one end side in the width direction and having a curved outer side surface facing forward, a stabilizer 29 having a bent shape and projecting outward on another end side in the width direction, and cutout portions 37, 38 open in a front end of the outer wall portion 17 on both widthwise sides of the bent portion 43.

13 Claims, 5 Drawing Sheets

(56) References Cited

U.S. PATENT DOCUMENTS 5,281,175 A * 1/1994 Chupak ..... H01R 13/113 439/839
5,607,328 A * 3/1997 Joly ..... H01R 13/11 439/851
5,681,190 A * 10/1997 Childs ..... H01R 13/11 439/842
5,690,517 A * 11/1997 Betsui ..... H01R 13/113 439/839
5,863,225 A * 1/1999 Liebich ..... H01R 13/18 439/845
5,951,336 A * 9/1999 Seko ..... H01R 13/432 439/745
5,951,338 A * 9/1999 Seko ..... H01R 13/18 439/843
5,954,548 A * 9/1999 Stabroth ..... H01R 13/434 439/839
6,679,738 B2 * 1/2004 Nimura ..... H01R 13/114 439/752.5
6,755,697 B2 * 6/2004 Kojima ..... H01R 13/114 439/595
6,905,376 B2 * 6/2005 Chen ..... H01R 13/04 439/595
7,048,582 B2 * 5/2006 Tabata ..... H01R 13/113 439/595
7,198,525 B2 * 4/2007 Nagamine ..... H01R 12/721 439/843
7,252,564 B1 * 8/2007 Morello ..... H01R 4/185 439/843
7,275,969 B2 * 10/2007 Fukaya ..... H01R 13/113 439/851
7,419,410 B2 * 9/2008 Myer ..... H01R 13/113 439/852
7,670,198 B2 * 3/2010 Shimizu ..... H01R 13/113 439/852
7,717,759 B2 * 5/2010 Ishigami ..... H01R 13/432 439/851
7,856,712 B2 * 12/2010 Busies ..... H01R 43/16 29/882
7,938,695 B2 * 5/2011 Furutani ..... H01R 4/185 439/852
7,976,351 B2 * 7/2011 Boemmel ..... H01R 13/432 439/748
7,988,505 B2 * 8/2011 Hotea ..... H01R 13/187 439/852
8,366,494 B2 * 2/2013 Nishide ..... H01R 13/113 439/752.5
8,662,935 B2 * 3/2014 Jouas ..... H01R 13/4223 439/660
9,972,932 B2 * 5/2018 Copper ..... H01R 13/113
10,122,108 B2 * 11/2018 Bhagyanathan Sathianathan ..... H01R 13/432
10,193,258 B2 * 1/2019 Balser ..... H01R 13/112
10,297,940 B2 * 5/2019 Tanikawa ..... H01R 13/4223
10,374,328 B2 * 8/2019 Bhagyanathan-Sathlanathan ..... H01R 13/432
2005/0287877 A1 * 12/2005 Fukuda ..... H01R 13/187 439/850
2013/0102180 A1 * 4/2013 Muro ..... H01R 13/4223 439/345

FOREIGN PATENT DOCUMENTS

JP 2014-222650 A 11/2014
WO WO-2018136877 A1 * 7/2018 ..... H01R 13/428

* cited by examiner

TERMINAL FITTING, METHOD OF PRODUCING THE SAME, AND CONNECTOR

CROSS-REFERENCE TO RELATED APPLICATIONS

This application is based on and claims priority from Japanese Patent Application No. 2019-219228, filed on Dec. 4, 2019, with the Japan Patent Office, the disclosure of which is incorporated herein in their entireties by reference.

TECHNICAL FIELD

The present disclosure relates to a terminal fitting, a method of producing the same, and a connector provided therewith.

BACKGROUND

A terminal (hereinafter, referred to as a terminal fitting) such as a female terminal disclosed in Japanese Patent Laid-open Publication No. 2014-222650 includes a box-shaped housing portion (hereinafter, referred to as a body portion). The body portion includes a fourth wall portion (hereinafter, referred to as an outer wall portion) along a width direction. An upper guard piece is provided on a front end part of the outer wall portion while being bent downward. The terminal fitting of this type is also disclosed in Japanese Patent Laid-open Publication No. 2003-022859 and Japanese Patent Laid-open Publication No. 2011-154944.

SUMMARY

Although not described in Japanese Patent Laid-open Publication No. 2014-222650, the terminal fitting is normally inserted into a cavity of a connector housing and locked by a locking lance. In this case, if a bent part of the upper guard piece is structured to contact the locking lance, the locking lance is smoothly deflected and the insertion workability of the terminal fitting can be improved.

However, the terminal fitting is often provided with a stabilizer for guiding an insertion operation into the connector housing. Here, if the stabilizer is structured to project from a wall portion other than the outer wall portion in the body portion, there is a problem of reducing a yield of the terminal fitting.

Accordingly, the present disclosure aims to improve a yield related to a terminal fitting.

This object is solved according to the invention by the features of the independent claims. Particular embodiments of the invention are subject of the dependent claims.

According to one aspect, there is provided a terminal fitting with a body portion substantially having a tubular shape and substantially extending in a front-rear direction, wherein the body portion includes an outer wall portion arranged from one end toward another end in a width direction, and the outer wall portion includes at least one bent portion curved inwardly on one end side in the width direction and having a curved outer side surface facing forward, at least one stabilizer having a bent shape and projecting outward on another end side in the width direction, and cutout portions open in a front end of the outer wall portion on both widthwise sides of the bent portion.

Accordingly, if the bent portion contacts a locking lance when the terminal fitting is inserted into a cavity of a connector housing, the locking lance can be smoothly deflected and deformed along the outer side surface of the bent portion and the insertion workability of the terminal fitting can be improved. Further, the stabilizer can guide an insertion operation of the terminal fitting into the housing. Particularly, according to the above configuration, since the stabilizer and the bent portion are efficiently and collectively provided in a formation range of the outer wall portion in the front-rear direction and the width direction, a yield can be improved.

According to a particular embodiment, the cutout portion located on the other widthwise side of the bent portion, out of the cutout portions, is open in a part of the stabilizer. According to this configuration, a width of the outer wall portion can be made smaller as compared to the case where the stabilizer, the cutout portion and the bent portion are respectively arranged side by side in the width direction. As a result, the terminal fitting can be miniaturized in the width direction.

Particularly, the stabilizer includes: a first leg portion and a second leg portion paired in the width direction, and a top portion arranged between the first and second leg portions, (i) wherein a second bent corner portion is located on another widthwise side of the top portion and connects the second leg portion and the top portion, (ii) wherein a first bent corner portion s located on one widthwise side of the top portion and connects the first leg portion and the top portion, and/or (iii) wherein a base end corner portion connects the first leg portion and the one end side in the width direction of the outer wall portion.

Further particularly, the cutout portion located on the other widthwise side of the bent portion, out of the cutout portions, is open in the base end corner portion, the first leg portion and the first bent corner portion.

Further particularly, the stabilizer includes a first leg portion and a second leg portion paired in the width direction, a top portion arranged between the first and second leg portions, a second bent corner portion located on another widthwise side of the top portion and connecting the second leg portion and the top portion, a first bent corner portion located on one widthwise side of the top portion and connecting the first leg portion and the top portion, and a base end corner portion connecting the first leg portion and the one end side in the width direction of the outer wall portion, and the cutout portion located on the other widthwise side of the bent portion, out of the cutout portions, is open in the base end corner portion, the first leg portion and the first bent corner portion. According to this configuration, since the rigidity of each of the base end corner portion and the first bent corner portion can be reduced by the cutout portion, the base end corner portion and the first bent corner portion can be easily bent and the bent shape of the stabilizer can be accurately formed.

Further particularly, the body portion includes a side wall portion arranged in a direction intersecting the outer wall portion and one corner portion connecting the outer wall portion and the side wall portion on the one end in the width direction, and the cutout portion located on the one widthwise side of the bent portion, out of the cutout portions, is open in the one corner portion. According to this configuration, since a corner shape of the one corner portion is eliminated by the cutout portion, a situation where a one-piece rubber plug is damaged due to interference with the one corner portion having the corner shape can be avoided when the terminal fitting passes through a seal hole of the rubber plug.

Further particularly, the body portion includes a side wall portion intersecting the outer wall portion on the one end in the width direction, and the side wall portion includes a fixing portion for locking either the outer wall portion or an inner wall portion at least partly overlapping the outer wall portion and retaining the tubular shape of the body portion. According to this configuration, the one end side in the width direction of the outer wall portion is a part hardly deformed by the side wall portion including the fixing portion. Thus, the positional accuracy of the bent portion located on the one end side in the width direction of the outer wall portion can be enhanced. As a result, the smoothness of a deflection operation of the locking lance can be ensured when the bent portion contacts the locking lance to deflect and deform the locking lance.

Further particularly, the stabilizer substantially is bent into a gate shape by bending the outer wall portion a plurality of times, and/or wherein the stabilizer is provided over the substantially entire length in the front-rear direction of the outer wall portion.

Further particularly, a front surface of the bent portion is arranged to substantially face forward on the front end of the outer wall portion and/or wherein a front end of the bent portion is arranged at the substantially same position as or retracted rearwardly from the front end of the stabilizer, the side wall portion and/or a base wall portion of the body portion.

According to another aspect, there is provided a connector comprising: a connector housing having at least one cavity provided therein; and at least one terminal fitting according to any one of the preceding claims at least partly insertable into the cavity.

According to another aspect, there is provided a method of producing a terminal fitting, in particular according to the above aspect or a particular embodiment thereof, comprising the following steps: providing a body portion substantially having a tubular shape and substantially extending in a front-rear direction, wherein the body portion includes an outer wall portion arranged from one end toward another end in a width direction, and forming in the outer wall portion: (i) at least one bent portion being curved inwardly on one end side in the width direction and having a curved outer side surface substantially facing forward; (ii) at least one stabilizer having a bent shape and projecting outward on another end side in the width direction; and (iii) cutout portions open in a front end of the outer wall portion on both widthwise sides of the bent portion.

According to the above, it is possible to provide a terminal fitting capable of improving a yield.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

A specific example of the terminal fitting of the present disclosure is described below with reference to the drawings. Note that the present disclosure is not limited to these illustrations and is intended to be represented by claims and include all changes in the scope of claims and in the meaning and scope of equivalents.

Embodiment

Figure 1:
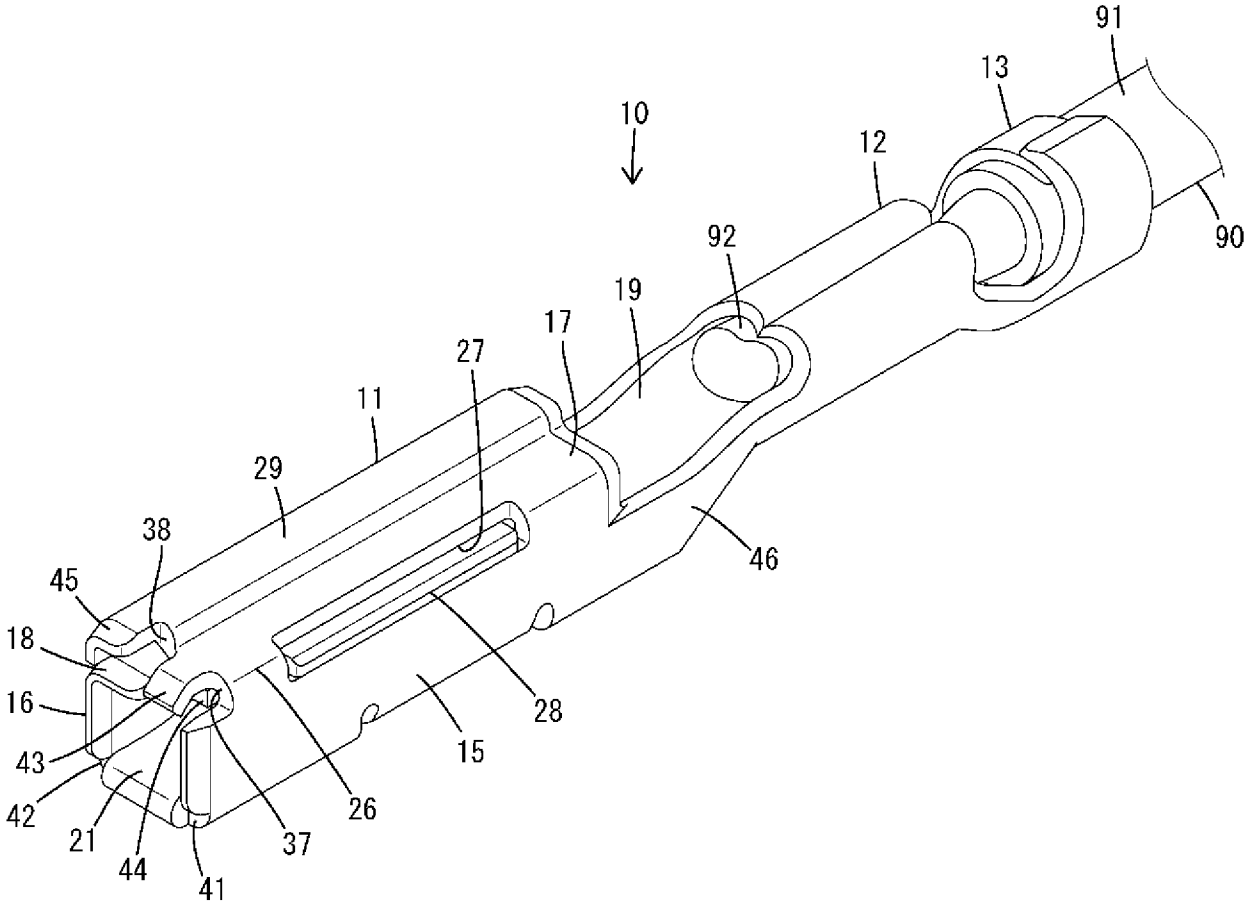
FIG. 1 is a perspective view of a terminal fitting according to one embodiment.

A terminal fitting 10 of one particular embodiment is formed, such as by bending a conductive (particularly metal) plate. The terminal fitting 10 substantially has an elongated shape in a front-rear direction. As shown in FIG. 1, the terminal fitting 10 includes a body portion 11 (particularly substantially in the form of a rectangular or polygonal tube) in or on a front part and a wire connection portion (particularly comprising at least one wire barrel portion 12 and/or at least one insulation barrel portion 13 in the form of open barrel(s)) to be connected to at least one wire 90 in or on a rear part.

Specifically, the insulation barrel portion 13 is arranged behind the wire barrel portion 12. The wire barrel portion 12 is to be crimped or folded or bent and connected to a conductor 92 (e.g. stranded wire or the like) exposed by removing a coating 91 particularly in a front end part of the wire 90. The insulation barrel portion 13 is to be crimped or folded or bent and connected to the coating 91 (coating 91 located adjacent to or behind the exposed conductor 92) particularly in the front end part of the wire 90.

Particularly, a length in the front-rear direction of the body portion 11 is longer than the wire connection portion (particularly than the sum of those of the wire barrel portion(s) 12 and the insulation barrel portion(s) 13).

Figure 3:
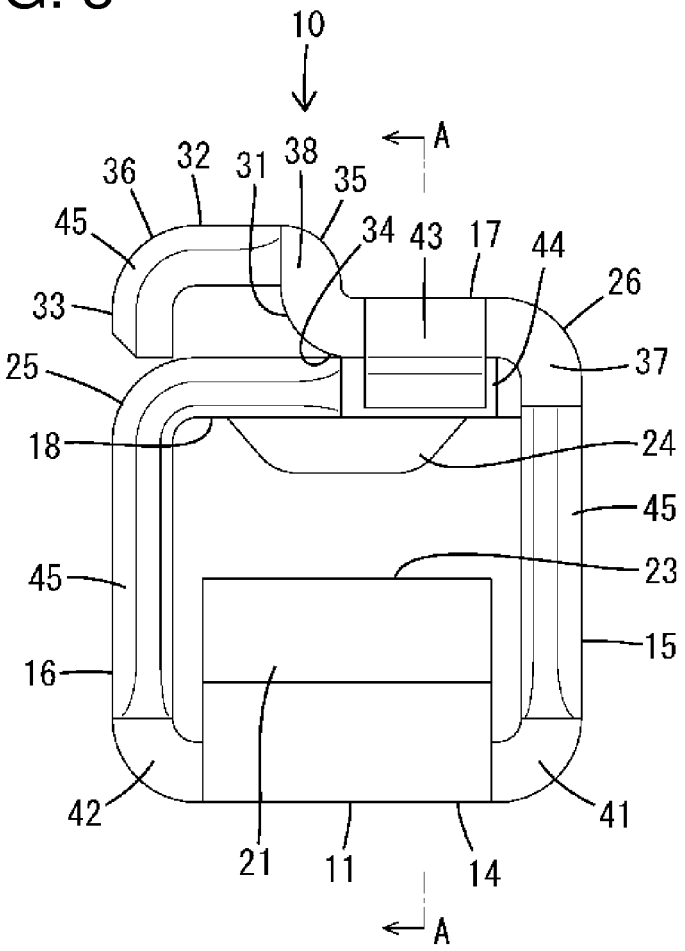
FIG. 3 is a front view of the terminal fitting.

As shown in FIG. 3, the body portion 11 includes a base wall portion 14, one or more, particularly a pair of side wall portions 15, 16 rising or projecting from (particularly both lateral (left and/or right) ends of) the base wall portion 14, an outer wall portion 17 shaped to extend from one side wall portion (at least partly side wall portion located on one widthwise end side (right side of FIG. 3); hereinafter, referred to as a first side wall portion 15) at least partly substantially toward the other side wall portion (side wall portion located on the other widthwise end side (left side of FIG. 3); hereinafter, referred to as a second side wall portion 16), and/or an inner wall portion 18 particularly shaped to extend from the second side wall portion 16 substantially toward the first side wall portion 15.

The base wall portion 14 particularly is a lower wall of the body portion 11, substantially arranged along the width direction and connected to the wire connection portion (particularly the wire barrel portion 12) via a coupling portion 19. Specifically, the (both) side wall portion(s) 15, 16 substantially is/are arranged along a vertical direction. The inner wall portion 18 particularly constitutes an upper wall of the body portion 11 and/or particularly is arranged substantially in parallel to the base wall portion 14 while being spaced apart from the base wall portion 14. The outer wall portion 17 particularly constitutes the upper wall of the body portion 11 and/or particularly is arranged to at least partly overlap the inner wall portion 18 from above (outside). The upper wall of the body portion 11 particularly at least partly has a double wall structure by being composed of the inner wall portion 18 and the outer wall portion 17. Rear end lower part(s) of the (particularly both) side wall portion(s) 15, 16 particularly is/are connected to one or more side portions 46 of the coupling portion 19 as shown in FIGS. 1 and 4.

Figure 4:
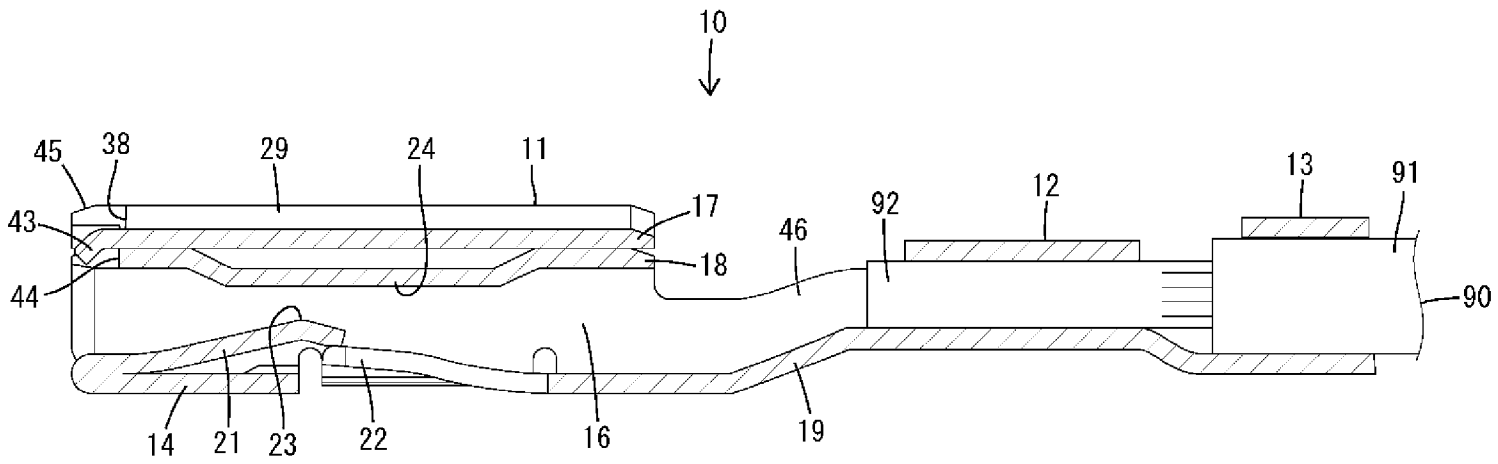
FIG. 4 is a section along A-A of FIG. 3.

As shown in FIG. 4, at least one contact piece 21 is provided in or at the body portion 11. The contact piece 21 is shaped to extend obliquely rearward from (particularly the front end of) the base wall portion 14. The contact piece 21 is vertically or laterally deflectable and deformable with a front end side of the base wall portion 14 as a fulcrum. Particularly, at least one auxiliary piece 22 is provided at a position at least partly overlapping the contact piece(s) 21 in the body portion 11. The auxiliary piece 22 specifically is cut and raised from the base wall portion 14 and shaped to extend obliquely forward. A rear end part (free end part) of the contact piece 21 particularly is bent obliquely downward, and supported from below or outside by a front end part (free end part) of the auxiliary piece 22. The contact piece 21 particularly includes a contact point portion 23 on a top part particularly substantially near the rear end part.

As shown in FIG. 4, the inner wall portion 18 particularly is provided with at least one receiving portion 24 substantially bent downward or in ward into a bead. The lower surface (inner surface) of the receiving portion 24 particularly substantially is arranged to be flat along the front-rear direction. The receiving portion 24 is arranged to substantially face the contact point portion 23 of the contact piece 21. A tab of an unillustrated mating terminal fitting at least partly is to be inserted between the receiving portion 24 and the contact point portion 23 of the contact piece 21 at the time of connecting a connector. The contact point portion 23 contacts the tab with the contact piece 21 deflected and deformed, whereby the both terminal fittings are to be electrically connected.

As shown in FIG. 3, the body portion 11 includes another (second) corner portion 25 connecting the second side wall portion 16 and the inner wall portion 18 and/or one (first) corner portion 26 connecting the first side wall portion 15 and the outer wall portion 17. The one (first) corner portion 26 is located above (or more outward along the vertical direction than) the other (second) corner portion 25 by a wall thickness (vertical thickness) of the inner wall portion 18. As shown in FIG. 1, the body portion 11 includes at least one fixing portion 27 in the form of a slit hole substantially extending in the front-rear direction along the one (first) corner portion 26 particularly at an intermediate part thereof along the front-rear direction. The fixing portion 27 is open in the first side wall portion 15 and/or the outer wall portion 17. The inner wall portion 18 includes at least one fixing piece 28 laterally projecting on an end part on the one widthwise end side. The fixing piece 28 particularly substantially is in the form of a rectangular plate piece long in the front-rear direction. The fixing piece 28 is to be at least partly fit into the fixing portion 27 of the body portion 11. Specifically, a tip part of the fixing piece 28 is located on an outer surface side of the first side wall portion 15 through the fixing portion 27. The fixing piece 28 at least partly is to be fit into and locked by the fixing portion 27, whereby the body portion 11 is retained in a (particularly substantially rectangular or polygonal) tube shape.

The outer wall portion 17 includes at least one stabilizer 29 projecting upward or outward (particularly substantially on a half part) on the other widthwise end side. Specifically, the stabilizer 29 is bent into a gate shape by bending the outer wall portion 17 a plurality of times. The stabilizer 29 particularly is provided over the substantially entire length in the front-rear direction of the outer wall portion 17.

Specifically, as shown in FIG. 3, the stabilizer 29 includes a first leg portion 31 rising upward or outward on a widthwise intermediate position (particularly a widthwise central side) of the outer wall portion 17, a top portion 32 arranged from an upper or distal end side of the first leg portion 31 toward the other widthwise side, and a second leg portion 33 hanging down (or projecting substantially toward the base wall portion 14) from the other widthwise end side of the top portion 32. The first and second leg portions 31, 33 particularly are arranged to substantially face each other on opposite widthwise end sides of the stabilizer 29. The top portion 32 particularly substantially is arranged along the width direction. The top portion 32 is arranged on a different level at a position higher (or more outward) than the one widthwise end side of the outer wall portion 17.

Specifically, the stabilizer 29 includes a base end corner portion 34 connecting the one widthwise end side of the outer wall portion 17 and the first leg portion 31, a first bent corner portion 35 at least partly connecting the top portion 32 and the first leg portion 31 on the one widthwise end of the top portion 32, and/or a second bent corner portion 36 at least partly connecting the top portion 32 and the second leg portion 33 on the other widthwise end of the top portion 32. The lower end of the top portion 32 particularly is a free end facing the other corner portion 25 from above.

Figure 2:
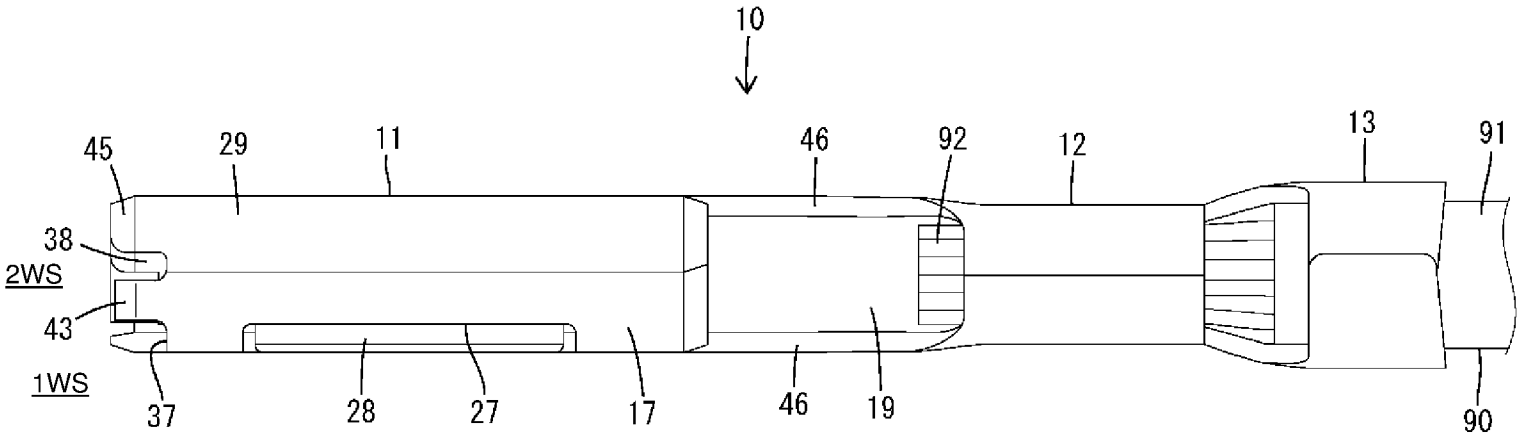
FIG. 2 is a plan view of the terminal fitting.

The outer wall portion 17 includes one or more, particularly a pair of cutout portions 37, 38 open (particularly substantially in the form of rectangular recesses) in a front end. The cutout portion 37 located on the one widthwise side 1WS is open in the front ends of the one widthwise side 1WS of the outer wall portion 17, the one corner portion 26 and/or the first side wall portion 15. As shown in FIGS. 1 and 2, the cutout portion 37 located on the one widthwise side 1WS is arranged in front of the fixing portion 27.

As shown in FIG. 3, the cutout portion 38 located on the other widthwise side 2WS is open in the front ends of the widthwise intermediate side (particularly substantially the widthwise central side) of the outer wall portion 17, the base end corner portion 34, the first side wall portion 15 and/or the first bent corner portion 35. The base end corner portion 34 and the first bent corner portion 35 have reduced rigidity on front end sides due to the formation of the cutout portion 38, and the stabilizer 29 can be easily bent.

As shown in FIG. 3, the body portion 11 particularly includes one side recess 41 retracted rearwardly from the front end(s) of the base wall portion 14 and/or the first side wall portion 15 particularly on a corner between the base wall portion 14 and the first side wall portion 15. Further, the body portion 11 particularly includes another side recess 42 retracted rearwardly from the front end(s) of the base wall portion 14 and/or the second side wall portion 16 particularly on a corner between the base wall portion 14 and the second side wall portion 16.

As shown in FIGS. 1 to 3, the outer wall portion 17 includes at least one bent portion 43 between the cutout portions 37, 38 particularly paired in the width direction on the one widthwise end side. The bent portion 43 is formed by bending a (particularly substantially rectangular) plate piece part located between the both cutout portions 37 and 38 in the outer wall portion 17 downward (inward). The bent portion 43 particularly is shaped to extend toward a front-lower side.

Specifically, a base end part of the bent portion 43 is curved by being bent. An outer side surface (curved outer side surface, front surface) of the bent portion 43 is arranged to substantially face forward on the front end of the outer wall portion 17. The front end of the bent portion 43 particularly is arranged at the same position as or retracted rearwardly from the front ends of the stabilizer 29, the first side wall portion 15, the second side wall portion 16 and the base wall portion 14. The lower end of the bent portion 43 is arranged to face the contact piece 21 from above.

The inner wall portion 18 includes at least one escaping recess 44 particularly open in a front end on the one widthwise end side 1WS. As shown in FIG. 4, the bent portion 43 can at least partly enter the escaping recess 44. In this way, the interference of the bent portion 43 and the inner wall portion 18 can be avoided.

Further, each of the first side wall portion 15, the second side wall portion 16, the inner wall portion 18 and the stabilizer 29 particularly includes at least one chamfered portion 45 on the front end of the outer surface thereof.

Mounting Structure of Terminal Fitting into Connector Housing

Figure 5:
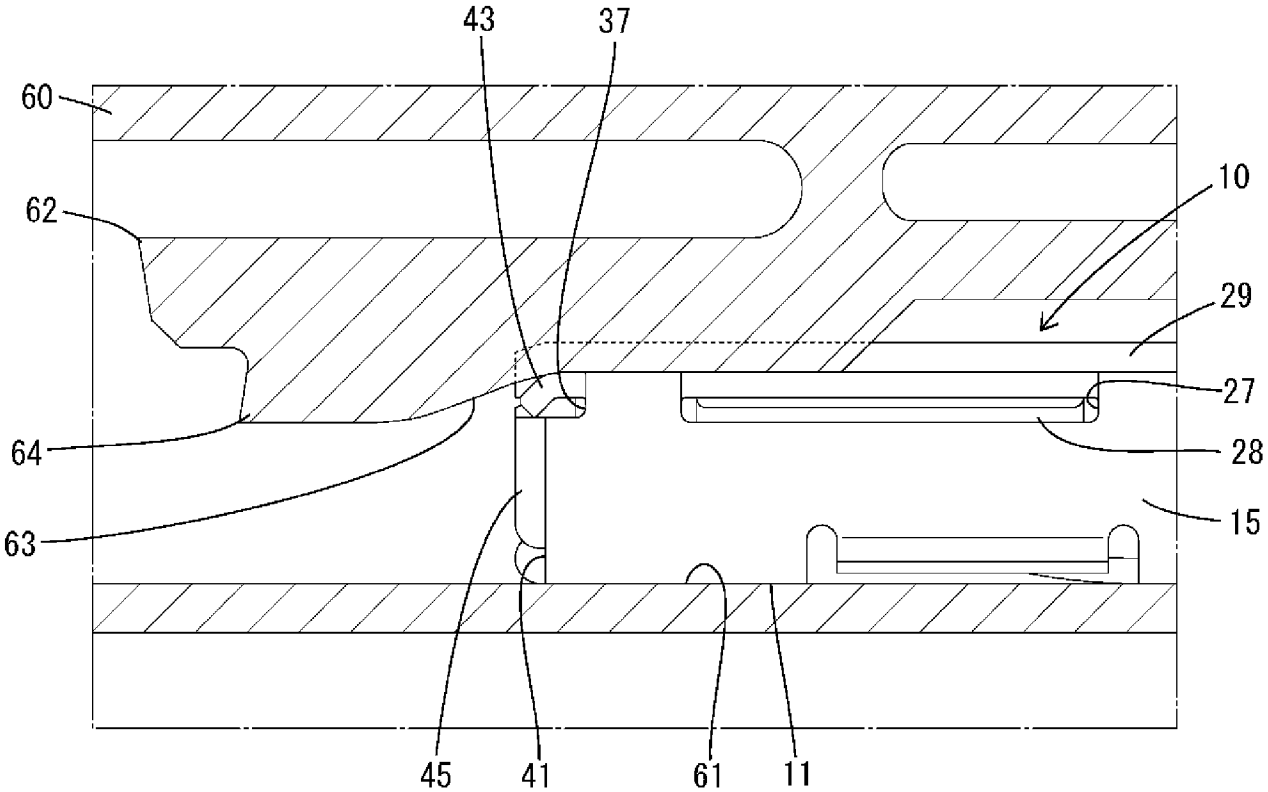
FIG. 5 is an enlarged view showing a state where the terminal fitting is inserted in a cavity of a connector housing and a bent portion is in contact with a locking lance.

As shown in FIG. 5, the terminal fitting 10 is to be at least partly inserted into a cavity 61 of a connector housing 60. In the process of inserting the terminal fitting 10 into the cavity 61, the stabilizer 29 at least partly enters a guiding groove communicating with the cavity 61 to guide an insertion operation of the terminal fitting 10. On the other hand, if an attempt is made to insert the terminal fitting in a vertically inverted posture into the cavity 61, the stabilizer 29 interferes with a rear wall of the connector housing 60 to stop the insertion operation of the terminal fitting 10. Thus, a situation where the terminal fitting 10 is erroneously mounted into the connector housing 60 can be avoided.

Further, in the process of at least partly inserting the terminal fitting 10 into the cavity 61, a slope portion 63 of a locking lance 62 at least partly contacts the outer side surface of the bent portion 43, whereby the locking lance 62 is deflected and deformed. The slope portion 63 of the locking lance 62 and the outer side surface of the bent portion 43 particularly are inclined with respect to the front-rear direction to substantially conform to an inclined posture of the deflected and deformed locking lance 62. Thus, the locking lance 62 is smoothly deflected by the contact of the slope portion 63 of the locking lance 62 and the outer side surface of the bent portion 43.

If the insertion operation of the terminal fitting 10 proceeds, the locking lance 62 contacts the outer surface of the outer wall portion 17 on the one widthwise end side 1WS and the deflected state of the locking lance 62 is maintained. Thereafter, when the terminal fitting 10 is properly inserted into the cavity 61, the locking lance 62 resiliently at least partly returns and a locking projection 64 of the locking lance 62 is arranged to substantially face the rear end of the body portion 11, particularly the rear end of the stabilizer 29. In this way, the terminal fitting 10 is locked by the locking lance 62 and held and retained in the cavity 61 of the connector housing 60.

Note that, if an unillustrated one-piece resilient plug (particularly rubber plug) is mounted into the connector housing 60, the terminal fitting 10 passes through a seal hole of the one-piece resilient (rubber) plug before being inserted into the cavity 61. The seal hole has a circular cross-section and the wire 90 is inserted thereinto in a fluid-tight manner (particularly liquid-tight manner). Here, the front ends of four corners of the body portion 11 may interfere with an opening edge of the seal hole of the one-piece resilient (rubber) plug to damage the one-piece rubber plug.

In the case of this embodiment, out of the front ends of the four corners of the body portion 11, the cutout portion 37 particularly is provided in the front end of the one corner portion 26 and/or the one side recess 41 and/or the other side recess 42 is/are provided in the front ends of two corners on the side of the base wall portion 14. The cutout portion 37, the one side recess 41 and the other side recess 42 are shaped to be able to avoid contact with the opening edge of the seal hole of the one-piece resilient (rubber) plug. Thus, the damage of the one-piece resilient (rubber) plug due to interference with one or more of the four corners of the body portion 11 can be prevented.

As described above, according to this embodiment, the locking lance 62 can be smoothly deflected and deformed by the contact of the locking lance 62 with the outer side surface of the bent portion 43.

The cutout portions 37, 38 particularly paired in the width direction are provided to be open in the front end of the outer wall portion 17, and/or the bent portion 43 is provided between the pair of cutout portions 37, 38 on the one widthwise end side 1WS of the outer wall portion 17. The stabilizer 29 having a bent shape is provided on the other widthwise end side 2WS of the outer wall portion 17. Thus, the bent portion 43 and the stabilizer 29 are efficiently and collectively provided without largely projecting in the front-rear direction and the width direction of the outer wall portion 17. As a result, a yield can be improved when the terminal fitting 10 is formed or manufactured.

Further, since the cutout portion 38 particularly is also open in a part of the stabilizer 29, a width of the outer wall portion 17 can be made smaller as compared to the case where the stabilizer 29, the cutout portion 38 and the bent portion 43 are respectively arranged side by side in the width direction in the outer wall portion 17.

In addition, the cutout portion 38 particularly is open in the front ends of the base end corner portion 34, the first leg portion 31 and the first bent corner portion 35 in the stabilizer 29. Thus, the rigidity of each of the base end corner portion 34 and the first bent corner portion 35 is reduced by the cutout portion 38 and the base end corner portion 34 and the first bent corner portion 35 can be easily bent.

Further, the first side wall portion 15 of the body portion 11 particularly is provided with the fixing portion 27. By fitting the fixing piece 28 of the inner wall portion 18 into the fixing portion 27, the tubular shape of the body portion 11 is retained. Thus, the one widthwise end side 1WS of the outer wall portion 17 is hardly deformed due to the presence of the fixing portion 27.

Since the bent portion 43 is provided on the one widthwise end side 1WS of the outer wall portion 17, the positional accuracy of the bent portion 43 is enhanced. As a result, the smoothness of a deflection operation of the locking lance 62 can be ensured when the bent portion 43 deflects and deforms the locking lance 62.

Other Embodiments of Present Disclosure

The embodiment disclosed this time should be considered to be illustrative in all aspects, rather than restrictive.

Although the terminal fitting particularly is a female terminal fitting to be connected by having the tab inserted into the body portion in the case of the above embodiment, the terminal fitting may be a male terminal fitting including a tab projecting from a body portion as another embodiment.

Although the upper wall of the body portion particularly has the double wall structure by being composed of or comprising the inner wall portion and the outer wall portion in the case of the above embodiment, an upper wall of a body portion may be composed only of an outer wall portion as another embodiment.

Although the bent portion particularly is provided on the half part of the outer wall portion on the one widthwise side and the stabilizer is provided on the half part of the outer wall portion on the other widthwise side in the case of the above embodiment, a bent portion may include a part extending to the other widthwise side beyond the half part of the outer wall portion on the one widthwise side or a stabilizer may include a part extending to the one widthwise side beyond the half part of the outer wall portion on the other widthwise side as another embodiment.

Although the fixing piece to be locked by the fixing portion particularly is provided on the inner wall portion in the case of the above embodiment, a fixing piece may be provided on an outer wall portion as another embodiment.

Accordingly, it is aimed to provide a terminal fitting capable of improving a yield. Thus, a terminal fitting 10 is provided with a body portion 11 substantially having a tubular shape and/or substantially extending in a front-rear direction. The body portion 11 includes an outer wall portion 17 substantially arranged from one end toward another end in a width direction. The outer wall portion 17 includes a bent portion 43 curved on one end side in the width direction and having a curved outer side surface substantially facing forward, at least one stabilizer 29 having a bent shape and substantially projecting outward on another end side in the width direction, and one or more cutout portions 37, 38 open in a front end of the outer wall portion 17 on at least one of (particularly both) widthwise sides of the bent portion 43.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A terminal fitting comprising:

a body portion substantially having a tubular shape and substantially extending in a front-rear direction of the terminal fitting, wherein the body portion includes an outer wall portion arranged from one end toward the other end in a width direction of the body portion, and the outer wall portion includes:

at least one bent portion curved inwardly on one end side in the width direction of the body portion and having a curved outer side surface substantially facing forward;

at least one stabilizer having a bent shape and projecting outward on the other end side in the width direction of the body portion; and cutout portions open in a front end of the outer wall portion on both widthwise sides of the bent portion, wherein the stabilizer is provided over a substantially entire length in the front-rear direction of the outer wall portion of the body portion.

2. The terminal fitting according to claim 1, wherein one of the cutout portions that is located on one widthwise side among the both widthwise sides of the bent portion is open in a part of the stabilizer.

3. The terminal fitting according to claim 2, wherein the stabilizer includes:

a first leg portion and a second leg portion paired in the width direction, and a top portion arranged between the first and second leg portions, wherein a first bent corner portion is located on one widthwise side of the top portion and connects the first leg portion and the top portion, wherein a second bent corner portion is located on the other widthwise side of the top portion and connects the second leg portion and the top portion, and wherein a base end corner portion connects the first leg portion and one end side in a width direction of the outer wall portion.

4. The terminal fitting according to claim 3, wherein the other of the cutout portions that is located on the other widthwise side among the both widthwise sides of the bent portion is open in the base end corner portion, the first leg portion and the first bent corner portion.

5. The terminal fitting according to claim 1, wherein:

the body portion includes a side wall portion arranged in a direction intersecting the outer wall portion and one corner portion connecting the outer wall portion and the side wall portion on the one end in the width direction of the body portion, and one of the cutout portions that is located on one widthwise side among the both widthwise sides of the bent portion is open in the one corner portion.

6. The terminal fitting according to claim 5, wherein a front surface of the bent portion is arranged to substantially face forward on the front end of the outer wall portion, and a front end of the bent portion is arranged at the substantially same position as or retracted rearwardly from a front end of each of the stabilizer, the side wall portion and a base wall portion of the body portion.

7. The terminal fitting according to claim 1, wherein:

the body portion includes a side wall portion intersecting the outer wall portion on the one end in the width direction of the body portion, and the side wall portion includes a fixing portion configured to lock either the outer wall portion or an inner wall portion at least partly overlapping the outer wall portion and retain the tubular shape of the body portion.

8. The terminal fitting according to claim 1, wherein the stabilizer substantially is bent into a gate shape by bending the outer wall portion a plurality of times.

9. The terminal fitting according to claim 1, wherein the bent portion and the stabilizer do not overlap each other in a vertical direction when viewed from a front of the body portion.

10. A connector comprising:

a connector housing having at least one cavity provided therein; and at least one terminal fitting at least partly insertable into the cavity, the terminal fitting comprising:

a body portion substantially having a tubular shape and substantially extending in a front-rear direction, wherein the body portion includes an outer wall portion arranged from one end toward the other end in a width direction of the body portion, and the outer wall portion includes:

at least one bent portion curved inwardly on one end side in the width direction of the body portion and having a curved outer side surface substantially facing forward;

at least one stabilizer having a bent shape and projecting outward on the other end side in the width direction of the body portion; and cutout portions open in a front end of the outer wall portion on both widthwise sides of the bent portion, wherein the stabilizer is provided over a substantially entire length in the front-rear direction of the outer wall portion of the body portion.

11. The connector according to claim 10, wherein the bent portion and the stabilizer do not overlap each other in a vertical direction when viewed from a front of the body portion.

12. A method of producing a terminal fitting, comprising:

providing a body portion substantially having a tubular shape and substantially extending in a front-rear direction of the terminal fitting, wherein the body portion includes an outer wall portion arranged from one end toward the other end in a width direction of the body portion, and the outer wall portion includes:

at least one bent portion curved inwardly on one end side in the width direction of the body portion and having a curved outer side surface substantially facing forward;

at least one stabilizer having a bent shape and projecting outward on the other end side in the width direction of the body portion; and cutout portions open in a front end of the outer wall portion on both widthwise sides of the bent portion, wherein the stabilizer is provided over a substantially entire length in the front-rear direction of the outer wall portion of the body portion.

13. The method of producing the terminal fitting according to claim 12, wherein the bent portion and the stabilizer do not overlap each other in a vertical direction when viewed from a front of the body portion.

* * * * *